US005749356A

United States Patent [19]

Mandeville et al.

[11] Patent Number: 5,749,356

[45] Date of Patent: May 12, 1998

[54] LOW NOX AND CO EMISSIONS DIRECT CONTACT HIGH TEMPERATURE WATER HEATER

[75] Inventors: Luc Mandeville, Terrebonne; Pascal Bocherel, Montreal; Kébir Ratnani, Boucherville; Michel Dallaire, Saint-Bruno-de-Montarville; Stéphane Brunet, Saint-Laurent, all of Canada

[73] Assignees: Gaz de France, La Plaine, France; Gaz Metropolitain, Montreal, Canada; New York Gas Group, New York, N.Y.; Sofame, Montreal, Canada

[21] Appl. No.: 817,160

[22] PCT Filed: Oct. 17, 1994

[86] PCT No.: PCT/CA94/00574

§ 371 Date: Jun. 13, 1997

§ 102(e) Date: Jun. 13, 1997

[87] PCT Pub. No.: WO96/12146

PCT Pub. Date: Apr. 25, 1996

[51] Int. Cl.[6] ..... F24H 1/10

[52] U.S. Cl. ..... 126/359

[58] Field of Search ..... 126/360 R, 360 A, 126/355, 359

[56] References Cited

U.S. PATENT DOCUMENTS 3,826,240 7/1974 Miyahara ..... 126/359

5,293,816 3/1994 Manderville et al. ..... 126/355

FOREIGN PATENT DOCUMENTS 1963850 7/1970 Germany .

OTHER PUBLICATIONS

PCT WO 83/00210 Wood 20 Jan. 1983.

*Primary Examiner*—Carroll B. Dority
*Attorney, Agent, or Firm*—Oblon, Spivak, McClelland, Maier & Neustadt, P.C.

[57] ABSTRACT

A gas-fired water heater is comprised of a vertical housing (11) having a circumferential side wall (12), a closed bottom end (13), and a flue (14) connected to a top end portion (15) thereof. A packing (17) of heat exchange elements (18) is supported inside the housing (11) in an uppermost region (19) thereof. A water discharge orifice or nozzle (21) is disposed above the packing (17) and connected to a water supply (22) for releasing water to be heated on the packing. An axial burner (23) is disposed substantially centrally with the housing under the packing (17). A feed pipe (24) is connected to the burner (23) and extends at least partly axially within the housing. A gas-air mixture is fed to the burner (23) through the feed pipe (24). An ignitor device (25) is provided to ignite the burner (23). The water is heated in the housing by contact with the packing (17) and an inner surface (12') of the housing (11) and in a space below the packing during the gravitational displacement of water droplets from the discharge orifice (21) to a collector chamber (31) below the burner.

11 Claims, 2 Drawing Sheets

LOW NOX AND CO EMISSIONS DIRECT CONTACT HIGH TEMPERATURE WATER HEATER

TECHNICAL FIELD

The present invention relates to a low NOX and CO emission gas-fired water heater wherein water droplets are heated by direct contact with a packing, the inner surface of the heater housing, and in the space within the housing.

BACKGROUND ART

Direct contact water heaters are known such as described in U.S. Pat. No. 5,293,861 assigned to Sofame Inc. wherein water is heated in a cylindrical column containing one or more packings of heat exchange elements which are heated by hot-air from a gas-fired burner located there below. The flame is introduced through a side wall of a cylindrical column containing the packing. With such water heater construction it is necessary to insulate the burner housing which is mounted adjacent the side wall of the burner. It is also desirable with such heater housings to provide a double wall cylindrical housing with cooling water interposed therebetween. Such water heaters are capable of heating water up to about 185° F. with NOX emissions below 40 ppm at 3% $O_2$ and CO emissions lower than 200 ppm.

DISCLOSURE OF THE INVENTION

There exists a need to provide a gas-fired water heater of the above-described type and wherein the NOX and CO emissions can still be lowered to those levels achieved by the above referred to direct contact water heater and wherein the housing can be constructed in a more economical manner by eliminating the need to insulate the side wall of the housing as well as the burner housing.

It is therefore a feature of the present invention to provide a gas-fired water heater which provides the above need.

According to a further feature of the present invention there is provided a gas-fired water heater of the column type and wherein the burner is axially supported within a vertically oriented cylindrical housing and disposed under a heat exchange packing.

Another feature of the present invention is to provide a gas-fired water heater wherein the burner feed pipe extends axially within the column and partly through the heat exchange packing wherein the gas mixture within the feed pipe is cooled by the packing to prevent flashback in the feed pipe.

Another feature of the present invention is to provide a gas-fired water heater and wherein the side wall of the column housing is cooled by water in contact with is inner surface and propagating from the top part of the column to a collecting reservoir in the bottom thereof.

Another feature of the present invention is to provide a gas-fired water heater wherein an axially supported burner is disposed under a heat exchange packing provided in an upper region of a vertically oriented cylindrical housing and wherein the burner has a cylindrical head which generates a short circumferential flame about the head side wall and wherein a deflector is provided above the flame to prevent water droplets from direct contact therewith to diminish CO emission by water contacting the flame.

According to the above features, from a broad aspect, the present invention provides a gas-fired water heater which comprises a vertical elongated housing having a circumferential side wall, a closed bottom end, and a flue connected to a top end portion thereof. A packing of heat exchange elements is supported inside the housing in an uppermost region thereof. Water discharge means is disposed above the packing and connected to a water supply for releasing water on the packing. An axially supported burner is disposed substantially centrally within the housing under the packing. A feed pipe is connected to the burner and extends at least partly axially within the housing. A gas-air mixture is fed to the burner through the feed pipe. Ignition means is provided to ignite the burner. The water released by the discharge means is heated by contact with the packing, the inner surface of the housing and in a space below the packing during the gravitational displacement of water droplets from the discharge means to a collection means below the burner where heated water is collected.

BRIEF DESCRIPTION OF DRAWINGS

A preferred embodiment of the present invention will now be described with reference to the accompanying drawings in which.

DESCRIPTION OF PREFERRED EMBODIMENTS

Figure 1:
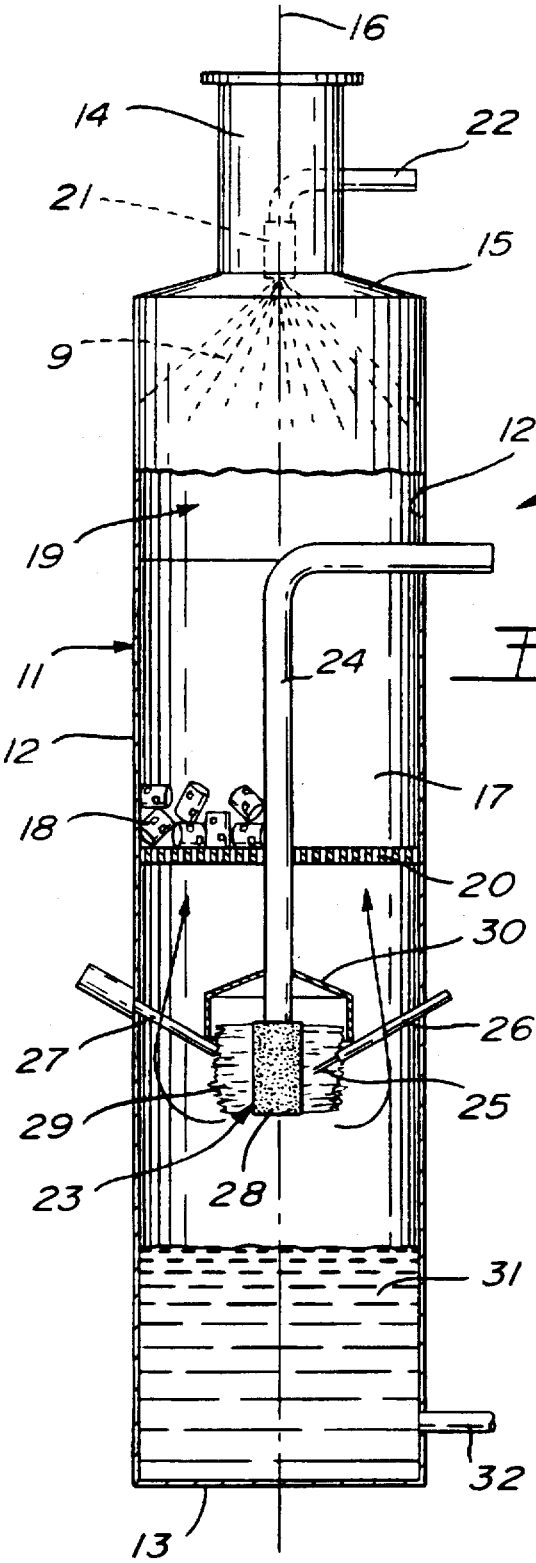
FIG. 1 is a simplified section view showing the construction of the gas-fired vertical column water heater of the present invention.

Referring now to the drawings and more particularly to FIG. 1 there is shown generally at 10 the gas-fired water heater of the present invention. As can be seen it consists of a vertical housing 11, herein formed as a cylinder of circular cross section, although other cross-sectional shapes are workable, and defining a circumferential side wall 12, an integrally closed bottom end 13, and a flue 14 connected to a top end portion thereof, and as herein shown a cylindrical flue disposed concentrically in a top wall 15 and axially aligned with the central longitudinal axis 16 of the housing. A side flue gas outlet may also be used.

A packing 17 of heat exchange elements 18, only a few being shown herein for simplicity of illustration, is supported inside the housing in an uppermost region 19 thereof. These heat exchange elements 18 are supported on a perforated support wall 20 or other suitable support permitting the passage of water. A water discharge means in the form of a spray nozzle 21 is disposed above the packing 17 and connected to a water pressure supply line 22 whereby to discharge water 9 over the packing 17 for heating the water within the housing 11.

An important aspect of the design of this water heater is the provision of an axial burner 23 disposed and supported substantially centrally within the housing under the packing 17 and along the central longitudinal axis 16 of the housing. A feed pipe 24 is connected to the burner 23 and extends at least partially axially within the housing and at least partly through the packing 17, as herein shown, whereby the packing also acts as a cooling medium for that portion of the feed pipe 24 whereby to maintain the gas-air mixture therein cooled to prevent ignition or flashback within the feed pipe.

The gas-air mixture is fed to the burner through this feed pipe by a gas-air feed circuit 40 which will be described later with reference to FIG. 3.

A spark ignitor 25 is disposed adjacent the burner 23 and supported by a support tube 26. A flame detector 27 may also be supported adjacent to the flame whereby to detect the presence of this flame to assure safer operation of the burner.

The burner as herein utilized has a head 28 which is constructed as a substantially metal fiber cylinder core which is also oriented axially with the central longitudinal axis 16 of the housing. This type of burner generates a circumferential flame 29 about the side wall surface thereof and no flame is generated downwardly.

A deflector shield 30 is secured about the feed pipe 24 above the burner head 28 and extends radially outwards to substantially encompass the circumferential flame 29 thereunder whereby to deflect water droplets falling by gravity from the packing outside the flame, and this diminishes CO emissions caused by water contact with the flame. As can be seen, the lower portion of the housing 11 constitutes a water reservoir 31 to collect hot water. An outlet pipe 32 is connected close to the bottom end of the housing to pump hot water from the reservoir 31.

In operation the burner flame 29 generates heat within the housing 19 which rises towards the top of the column to exit through the flue 14. The heat is, of course, highly concentrated around the burner and heats the side walls of the housing and propagates upwardly to heat the heat exchange elements 18 forming the packing. Some of the water 9 released by the spray nozzle 21 is in contact with the inner surface 12' of the side wall 12 of the housing as well as the heat exchange elements 18 and propagate downwardly by gravity. During their travel through the packing water droplets extract heat from the elements 18 as well as the side wall of the housing and directly from hot gases. This water propagating on the inner surface of the side wall also cools the side wall while extracting heat and eliminates the need of having a double wall housing with cooling water interposed therebetween. The heater is therefore smaller and lighter. As the water propagates below the packing it is also heated in the space around the flame in this portion of the housing which is substantially hotter due to its close proximity to the flame. The hot water is collected in the lower portion of the housing in the reservoir 31.

An advantage of mounting the burner axially eliminates the need to have the burner housed in a special insulated housing disposed against the side wall of the vertical stack or housing 11, as is the case with vertical column heaters. This particular design also produces sought after features not heretofore attainable with prior art water heaters of this class and permits a reduction of CO and NOX emission. The water heater of the present invention produces water temperatures of about 200° F. with low NOX emissions of less than 15 ppm at 3% $O_2$.

Figure 2:
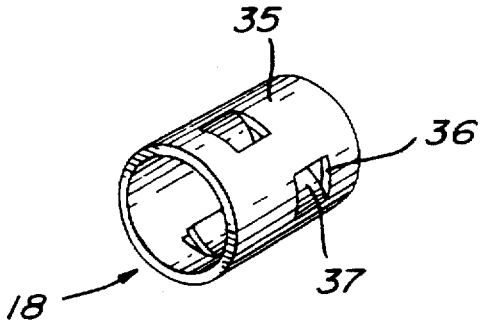
FIG. 2 is a perspective view showing the construction of heat exchange elements which may be used to form the packing.

FIG. 2 illustrates the construction of the heat exchange elements 18 as herein utilized but it is pointed out that other types of heat exchange elements can be utilized for the packing 17. As herein shown these elements are constituted by short hollow cylindrical metal tube sections 35 having a plurality of heat-sink sections 36 which are formed by punching flanges 37 in the side wall thereof to produce heat-sinks to provide better heat exchange with water propagating by gravity down the packing.

Figures 3, 4:
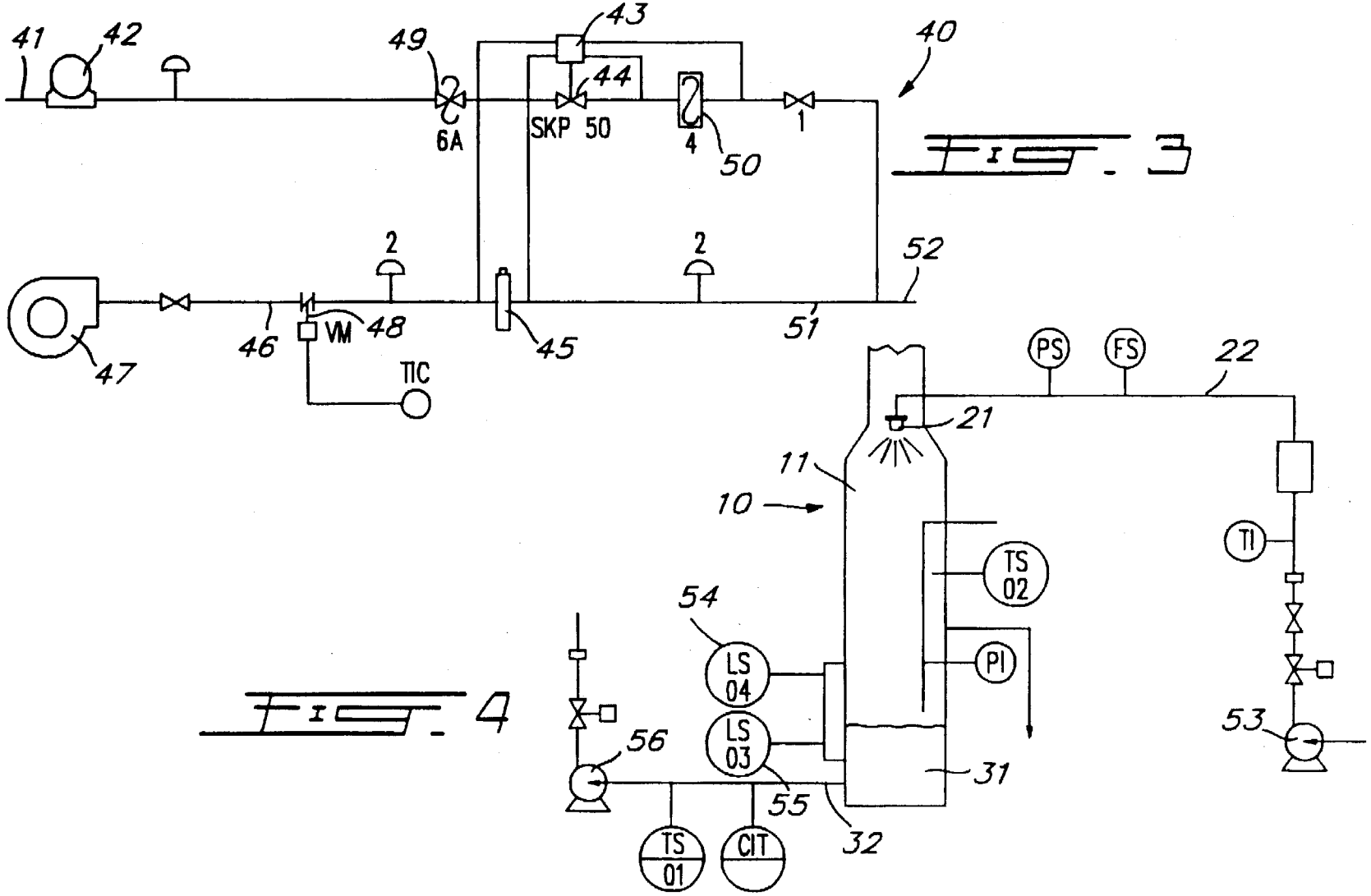
FIG. 3 is a simplified schematic diagram showing the gas-air feed circuit.
FIG. 4 is a simplified schematic diagram showing the water feed circuit connected to the gas-fired water heater along with the outlet pump and level sensors.

FIG. 3 is a block diagram illustrating a typical gas-air feed circuit 40. As herein shown a natural gas feed line 41 is connected to a pressure regulator 42 and feeds a modulating controller 43 connected to a controllable valve 44. Modulating controller 43 is also connected across the orifice 45 of an air pressure line 46 fed by a blower 47. The line 46 is connected to an air valve 48 and also directly to the orifice 45. An electrovalve 49 is connected upstream of the valve 44 which is controlled by the modulating controller 43. The modulating controller 43 senses the amount of air being supplied through the orifice 45 in the feed line 51 and the amount of gas being supplied through the adjustable orifice 50 in the natural gas feed line 41 so that a constant gas-air mixture may be fed to its outlet 52 which is connected to the feed pipe 24 of the burner 23. This feed circuit is substantially of standard design.

FIG. 4 is a simplified diagram of the water supply showing a water pump 53 connected to the water pressure supply line 22 to feed the nozzle 21 located in the top part of the vertical housing 11. As herein shown level control switches 54 and 55 are secured to the side wall of the vertical housing 11 in the water reservoir section 31 thereof to sense the level of water present inside the reservoir. A pump 56 pumps heated water out of the reservoir through the outlet pipe 32. This is also standard design.

It is within the ambient of the first invention to cover any obvious modifications of the preferred embodiments described herein, providing such modifications fall within the scope of the appended claims.

We claim:

1. A gas-fired water heater comprising a vertical housing (11) having a circumferential side wall (12), a closed bottom end (13), and flue (14) connected to a top end portion (15) thereof; a packing (17) of heat exchange elements (18) supported inside said housing (11) in an uppermost region (19) thereof, water discharge means (21) disposed above said packing (17) and connected to a water supply (22) for releasing water (9) on said packing, an axial burner (23) disposed substantially centrally within said housing (11) under said packing (17), a feed pipe (24) connected to said burner (23) and extending at least partly axially within said housing, a gas-air mixture fed to said burner (23) through said feed pipe (24), and ignition means (25) to ignite said burner; said water being heated by contact with said packing (17), an inner surface (12) of said housing (11) and in a space below said packing during the gravitational displacement of water droplets from said discharge means to a collection means (31) below said burner.

2. A gas-fired water heater as claimed in claim 1 wherein said burner has a substantially metal fiber cylinder head (28) having its longitudinal axis oriented axially with a central longitudinal axis (16) of said housing (11), said burner (23) generating a circumferential radial flame (29) about said metal fiber cylinder.

3. A gas-fired water heater as claimed in claim 2 wherein there is further provided a deflector member (30) secured above said burner to deflect water droplets falling from said packing to an outer periphery of said circumferential flame (29).

4. A gas-fired water heater as claimed in claim 1 wherein said feed pipe (24) has a section thereof disposed and extending in said packing whereby said gas mixture therein is cooled by said packing (17) to prevent flashback in said feed pipe (24).

5. A gas-fired water heater as claimed in claim 1 wherein said housing (11) is a cylindrical housing of circular cross-section, said housing having a single side wall (12) structure.

6. A gas-fired water heater as claimed in claim 5 wherein said single side wall structure (12) is cooled by said water (9) being displaced by gravitational displacement against and adjacent on inner face (12') of said side wall (11).

7. A gas-fired water heater as claimed in claim 1 wherein said ignition means (25) is a spark ignitor disposed adjacent said burner, and a flame detector (27) also secured adjacent said burner to detect its operation.

8. A gas-fired water heater as claimed in claim 1 wherein said collection means (31) is constituted by a bottom section of said housing (11), and an outlet pipe (32) secured to said bottom section and connected to a pump (56) to discharge heated water from said bottom section.

9. A gas-fired water heater as claimed in claim 1 wherein said water heater (10) produces water temperatures of about 200° F. with low NOX emissions of less than 15 ppm at 3% $O_2$.

10. A gas-fired water heater as claimed in claim 1 wherein said water discharge means (21) is a spray nozzle.

11. A gas-fired water heater as claimed in claim 1 wherein said heat exchanger elements (18) are hollow cylindrical metal tube sections (35) having a plurality of heat-sink sections (36) integrally formed in a cylindrical side wall thereof.

* * * * *